United States Patent [19]

Gustavsson

[11] 4,269,578

[45] May 26, 1981

[54] APPARATUS FOR FORMING A WEB OF MATERIAL

[75] Inventor: Lennart Gustavsson, Växjö, Sweden

[73] Assignee: Aktiebolaget Svenska Flaktfabriken, Stockholm, Sweden

[21] Appl. No.: 84,109

[22] Filed: Oct. 12, 1979

Related U.S. Application Data

[60] Division of Ser. No. 884,850, Mar. 9, 1978, Pat. No. 4,197,267, which is a continuation-in-part of Ser. No. 725,726, Sep. 21, 1976, Pat. No. 4,099,296.

[30] Foreign Application Priority Data

Sep. 26, 1975 [SE] Sweden ..... 7510795

[51] Int. Cl.[3] ..... B28B 5/00

[52] U.S. Cl. ..... 425/83.1; 264/121

[58] Field of Search ..... 425/83.1; 264/121

[56] References Cited

U.S. PATENT DOCUMENTS

| | | | |
|---|---|---|---|
| 3,408,697 | 11/1968 | Craig | 425/83.1 |
| 3,777,231 | 12/1973 | Guschin | 264/121 |

FOREIGN PATENT DOCUMENTS

| | | | |
|---|---|---|---|
| 709612 | 5/1954 | United Kingdom | 264/121 |
| 247083 | 11/1969 | U.S.S.R. | 264/121 |

*Primary Examiner*—Donald E. Czaja
*Assistant Examiner*—James R. Hall
*Attorney, Agent, or Firm*—Dann, Dorfman, Herrell and Skillman

[57] ABSTRACT

A web is formed from particulate material, for example, wood fibers, by depositing the fibers on a conveyor surface in a distribution chamber. The particulate material is introduced into the distribution chamber at its top by a carrier air stream which is caused to oscillate across the surface by impulses from separate control blow boxes on the opposite sides of the stream. The particulate material is thoroughly dispersed in the air stream by passage through a transition zone where the carrier air stream is deflected into a zigzag path and its flow velocity is reduced. The effect of static electricity on the particles in the carrier stream is reduced by lining the transition zone with nonconductive material and providing ionizing devices in the blow boxes for the air flow passing through the control boxes, or in the chamber adjacent the boxes.

4 Claims, 6 Drawing Figures

APPARATUS FOR FORMING A WEB OF MATERIAL

This is a division of Application Ser. No. 884,850 filed Mar. 9, 1978, now U.S. Pat. No. 4,197,267, which is a continuation-in-part of Ser. No. 725,726, filed Sept. 21, 1976, now U.S. Pat. No. 4,099,296.

The present invention relates to an apparatus for forming a web and constitutes an improvement on the apparatus shown in my co-pending application above-identified.

As shown in my prior patent, a web is formed on a conveyor by carrying particulate material into a distribution chamber by means of a carrier air stream. The air stream is oscillated across the width of the chamber by impulses from control jets to form a web on the conveyor surface which has proved very efficient with a good yield with respect to uniformity and quality in general. In certain installations, however, problems have arisen when the composite stream of materials supplied to the distribution chamber is discharged with sufficient speed to form streaks, resulting in irregularities in the web formed. Furthermore, static electricity generated by wood particles, in particular particles which have a moisture content of below 10%, causes irregularities in the forming process since the charged particles may deposit on the walls of the chamber and are dropped randomly in clumps. Under severe conditions the electrostatic charge may be sufficient to cause sparking. The present invention provides means for eliminating these problems and thereby enhances the uniformity and quality of the web material formed, regardless of the problems caused by the materials discussed above.

Specifically, the present invention provides a transition zone for the composite stream of carrier air and the particulate material in advance of its entry into the distribution chamber to assure uniform dispersion of the particulate material through the carrier air stream, and the invention also reduces the static electricity on the particles in the distribution chamber.

All of the objects of the invention are more fully set forth hereinafter with reference to the accompanying drawings, wherein.

Figure 5:
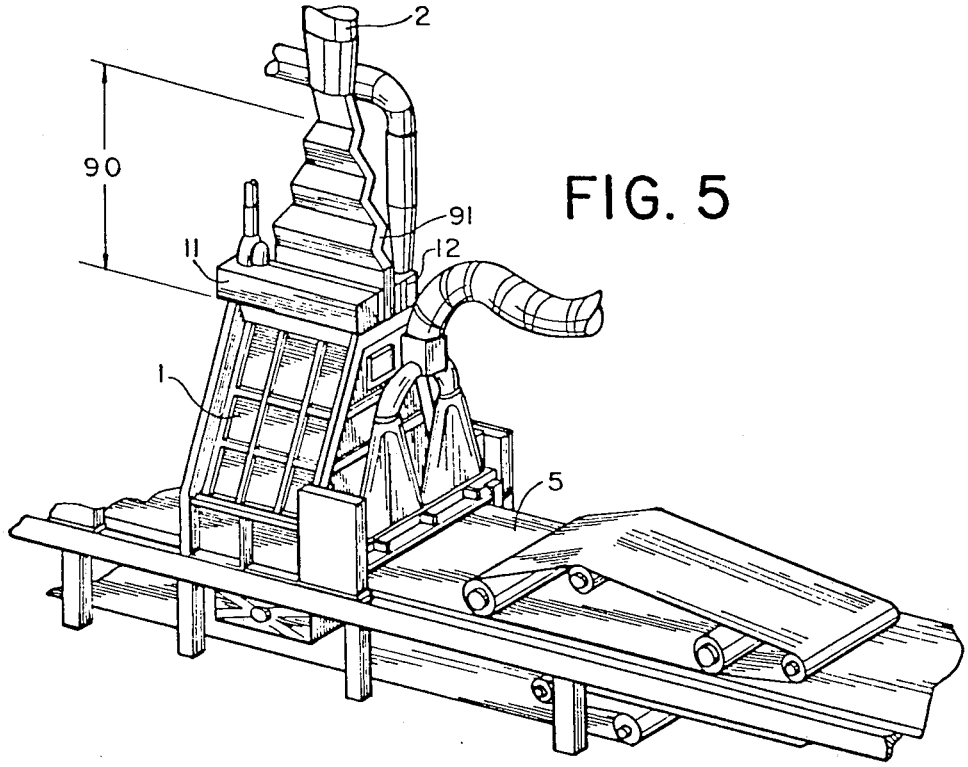
FIG. 5 is a perspective view of web-forming apparatus embodying the present invention.
Figure 6:
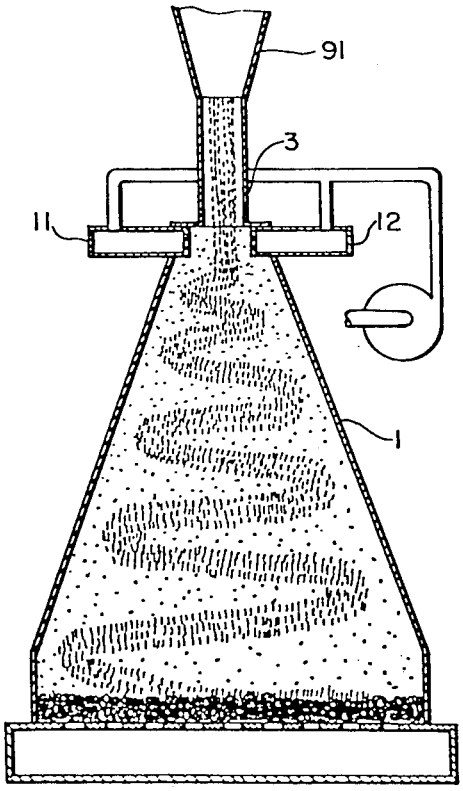
FIG. 6 is a transverse section through the distribution chamber.

With reference to FIG. 5, the apparatus of the present invention provides a distribution chamber 1 which is open at its bottom to accommodate a running conveyor belt 5 which forms the deposition surface of the web forming apparatus. At the top of the chamber 1, blow boxes 11 and 12 are provided on opposite sides of an inlet nozzle 3 which is connected to a supply conduit 2 through a transition zone 90 having a zigzag-shaped passageway 91. As indicated in FIG. 6, the composite stream from the passageway 91 is introduced into chamber 1 through the nozzle 3 and is caused to oscillate across the width of the chamber by means of impulse jets from the blow boxes 11 and 12, as described in detail in the prior patent.

Figure 1:
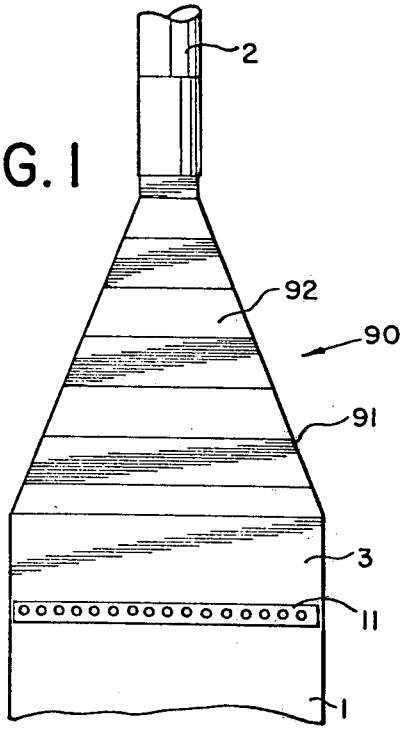
FIG. 1 is a longitudinal section through a transition zone of the web forming apparatus.
Figure 2:
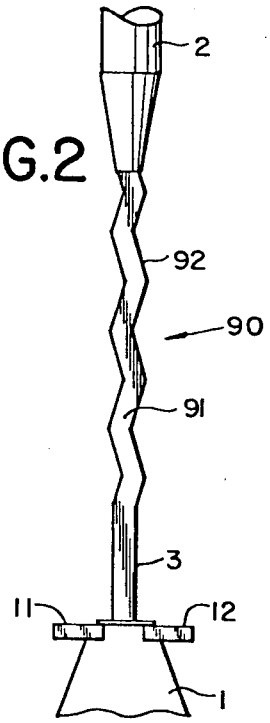
FIG. 2 is a cross section of the transition zone.

In accordance with the present invention, the transition zone 90 provides a thorough dispersion of the particulate material throughout the carrier air flow. To this end, the cross section of the transition zone diverges in the direction of the fiber flow and the longitudinal direction of the web being formed. As further appears from FIGS. 2 and 5, the transition zone 90 provides a zigzag passageway having successive walls disposed at an obtuse angle to each other to provide a plurality of deflectors which thereby deflects the carrier air stream with the particles therein several times throughout its passage through the transition zone 90. Each deflection of the composite stream generates a resistance which is balanced with the change in dynamic pressure resulting from the reduction of air velocity caused by the expanding cross section of the passageway. The combination of the reducing air speed and the deflecting walls of the passageway assures against limited zones of excess speed which might cause streaks. Thus, the composite gas/particle stream has a uniform speed profile as it leaves the nozzle 3 and flows into the distribution chamber 1. During the passage of the composite stream through the transition zone, the velocity of the flow is reduced, for example, from 25 meters per second to 10 meters per second. Preferably the velocity of the composite stream is reduced to at least one half its initial velocity.

In accordance with another feature of the invention, the transition passageway 91 is lined with wood material 92, preferably plywood, wood fiberboard or the like, whereby an efficient reduction of the static electricity of the particles or fibers is obtained. As an example, it may be mentioned that tests have proved that the use of this device results in a reduction in electric field strength from to 200,000 V/m to about 30,000 V/m. The invention is not limited to this particular configuration of transition zone, but other forms are possible. For example, the transition zone may be located remote from the distribution chamber in the distribution conduit 2.

Figure 3:
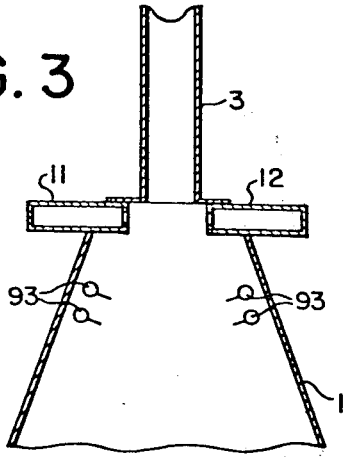
FIG. 3 illustrates the positioning of ionizing rods disposed in the distribution chamber.
Figure 4:
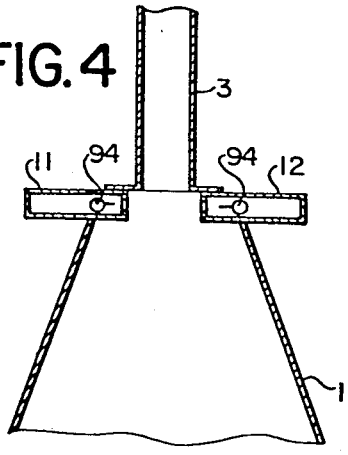
FIG. 4 illustrates ionizing rods mounted in the blow boxes.

In FIGS. 3 and 4, embodiments of blow boxes 11 and 12 are shown in detail. As shown in FIG. 3, ionizing rods 93 are disposed in the distribution chamber adjacent the blow boxes in order to further reduce static electricity. The ionizing rods are connected to an alternating-current source (not shown) to provide an electric voltage which ionizes the ambient gas and thereby reduces any static electricity remaining with the fibers of the composite stream issuing from the nozzle 3. Preferably the applied voltage is in an alternating-current voltage in the range of 3–20 kv. In FIG. 4, ionizing rods 94 are disposed within the blow boxes 11 and 12 for ionizing the flow which generates the impulse jets for controlling the oscillation of the composite stream through the distribution chamber 1. By this arrangement, the impulse jets are ionized and are efficiently mixed into the composite stream. The ionizing rods, being disposed in the blow box, are protected against mechanical damage and are also protected against dust loading. Furthermore, the shielding of the rods within the blow box insures against contact with the personnel servicing installation.

While particular embodiments of the present invention have been herein illustrated and described, it is apparent that the invention is not limited to the particular embodiments illustrated but the features may be combined and modified, all within the scope of the following claims.

I claim:

1. In an apparatus for forming a web of particulate material comprising a distribution chamber, a carrier surface provided therein, a nozzle opening within the distribution chamber for supplying a composite stream of particulate material distributed in a carrier gaseous medium, and blow box means for supplying control jets of air to opposite sides of said composite stream to impart a variable impulse to cause said composite stream to be distributed across the full width of the distribution chamber and the carrier surface therein, the improvement comprising a transition zone provided in advance of said nozzle opening through which said composite stream must pass, said transition zone comprising a zigzag passageway which diverges in cross section toward the distribution chamber in the direction of movement of the carrier surface to assure uniform dispersion of the particulate material throughout the carrier gaseous medium.

2. The apparatus according to claim 1 wherein said transition zone has walls forming a passageway for the composite stream, said walls being composed of material for reducing the charge of static electricity occurring on the particulate material.

3. Apparatus according to claim 2 wherein said material is composed of wood.

4. The apparatus according to claim 1 wherein the zig-zag passageway is provided by successive walls along the length of the passageway disposed at an obtuse angle to each other to provide a plurality of deflectors for deflecting the composite stream passing through the zigzag passageway, the deflectors cooperating with the diverging cross-section of the transition zone to provide a uniformly reduced composite stream speed profile as the composite stream passes through the nozzle opening.

* * * * *